US008635874B2

(12) United States Patent
Eroglu et al.

(10) Patent No.: US 8,635,874 B2
(45) Date of Patent: Jan. 28, 2014

(54) GAS TURBINE COMBUSTOR INCLUDING AN ACOUSTIC DAMPER DEVICE

(75) Inventors: Adnan Eroglu, Untersiggenthal (CH); Ewald Freitag, Baden (CH); Uwe Rüdel, Baden-Rütihof (CH); Urs Benz, Gipf-Oberfrick (CH); Andreas Huber, Stuttgart (DE)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/424,839

(22) Filed: Mar. 20, 2012

(65) Prior Publication Data

US 2012/0260657 A1 Oct. 18, 2012

Related U.S. Application Data

(63) Continuation of application No. PCT/EP2010/063513, filed on Sep. 15, 2010.

(30) Foreign Application Priority Data

Sep. 21, 2009 (EP) ..... 09170877

(51) Int. Cl.
*F02C 7/24* (2006.01)

(52) U.S. Cl.
USPC ..... 60/725; 431/114; 60/752

(58) Field of Classification Search
USPC ..... 60/752–760, 725; 431/114; 181/213
See application file for complete search history.

(56) References Cited

U.S. PATENT DOCUMENTS

| | | | | |
|---|---|---|---|---|
| 5,373,695 | A | 12/1994 | Aigner et al. | |
| 6,464,489 | B1 * | 10/2002 | Gutmark et al. | 431/1 |
| 6,530,221 | B1 * | 3/2003 | Sattinger et al. | 60/725 |
| 6,981,358 | B2 * | 1/2006 | Bellucci et al. | 60/39.17 |
| 7,076,956 | B2 * | 7/2006 | Young et al. | 60/725 |
| 7,089,741 | B2 * | 8/2006 | Ikeda et al. | 60/725 |
| 7,104,065 | B2 | 9/2006 | Benz et al. | |
| 7,413,053 | B2 * | 8/2008 | Wasif et al. | 181/293 |
| 7,448,215 | B2 * | 11/2008 | Macquisten et al. | 60/725 |
| 8,146,364 | B2 * | 4/2012 | Johnson et al. | 60/725 |
| 2005/0166596 | A1 * | 8/2005 | Sattinger | 60/772 |

(Continued)

FOREIGN PATENT DOCUMENTS

| | | | |
|---|---|---|---|
| DE | 102006053277 | A1 | 5/2008 |
| EP | 1605209 | A1 | 12/2005 |

(Continued)

OTHER PUBLICATIONS

International Search Report (PCT/ISA/210) issued on Jan. 27, 2011, by European Patent Office as the International Searching Authority for International Application No. PCT/EP2010/063513.

(Continued)

*Primary Examiner* — William H Rodriguez
(74) *Attorney, Agent, or Firm* — Buchanan Ingersoll & Rooney PC

(57) ABSTRACT

An exemplary combustor includes at least a portion having an inner liner and an outer cover plate, which together form an interposed cooling chamber. A plurality of hollow elements extend from the liner and protrude into the cooling chamber. Each hollow element defines a damping volume connected to an inner volume of the combustion chamber via a calibrated duct. During operation, the hollow elements damp pressure pulsations and, in addition, also transfer heat.

13 Claims, 4 Drawing Sheets

(56) References Cited

U.S. PATENT DOCUMENTS

| | | | | |
|---|---|---|---|---|
| 2006/0059913 | A1 | 3/2006 | Bethke et al. | |
| 2006/0123791 | A1* | 6/2006 | Macquisten et al. | 60/725 |
| 2007/0283700 | A1 | 12/2007 | Gerendas et al. | |
| 2008/0087019 | A1 | 4/2008 | Macquisten et al. | |
| 2008/0216481 | A1 | 9/2008 | Pollarolo | |
| 2009/0094985 | A1 | 4/2009 | Johnson et al. | |
| 2010/0186411 | A1* | 7/2010 | Matsuyama et al. | 60/725 |
| 2011/0048020 | A1* | 3/2011 | Mueller et al. | 60/725 |
| 2011/0265484 | A1* | 11/2011 | Huber et al. | 60/755 |

FOREIGN PATENT DOCUMENTS

| | | | |
|---|---|---|---|
| EP | 1862739 | A2 | 12/2007 |
| EP | 1865259 | A2 | 12/2007 |
| FR | 2570129 | A1 | 3/1986 |
| WO | WO 2005/059441 | A1 | 6/2005 |
| WO | WO 2009/038611 | A2 | 3/2009 |

OTHER PUBLICATIONS

Written Opinion (PCT/ISA/237) issued on Jan. 27, 2011, by European Patent Office as the International Searching Authority for International Application No. PCT/EP2010/063513.

European Search Report dated Feb. 16, 2010 for European Application No. 09170877.6.

* cited by examiner

GAS TURBINE COMBUSTOR INCLUDING AN ACOUSTIC DAMPER DEVICE

RELATED APPLICATION(S)

This application is a continuation application under 35 U.S.C. §120 to PCT/EP2010/063513 which was filed as an International application on Sep. 15, 2010 designating the U.S., and which claims priority to European Patent Application No. 09170877.6 filed in Europe on Sep. 21, 2009, the entire contents of which are hereby incorporated by reference in their entireties.

FIELD

The present disclosure relates to a gas turbine, such as, a gas turbine that includes a combustor.

BACKGROUND INFORMATION

Known gas turbines can include combustors wherein compressed air coming from the compressor is fed and mixed with a gaseous or liquid fuel that is combusted in the combustor.

Under certain conditions, such as when low emissions are pursued or at part load, for example, pressure oscillations can be generated in the combustor due to thermo acoustic instabilities. These pressure oscillations can cause structural damages or excessive wear of the gas turbine components and, in addition, a noisy operation.

In an effort to guarantee an acceptable gas turbine lifetime and control noise, pressure oscillations during operation of the gas turbine should be damped.

In known implementations damping can be achieved by passive damping structures. Examples of these passive damping structures are Helmholtz resonators, quarter-wave tubes, screen or perforated screech liners. During manufacture, known gas turbines are first designed and optimized without passive damping structures. Passive damping structures can be later added, as necessary, based on desired results of a specified implementation. As a result, in order to provide proper cooling of damping structures, cooling air should be diverted from other gas turbine regions, causing an increase in operating temperature and shortening its operational lifetime.

In addition, as often as air is taken away from the combustor (or in sequential combustion gas turbines from the first combustor) the flame temperature increases thus increasing the NOx emissions.

U.S. Pat. No. 7,104,065 discloses a damping arrangement for a combustor with a two-walled combustion chamber and a further outer wall defining a gastight volume connected to the inner of the combustion chamber. In addition to the drawbacks already described, this damping arrangement is functionally separated from the other components of the combustor and, moreover, it proved difficult to incorporate it in the combustor, due to the limited space available.

SUMMARY

An exemplary combustor is disclosed comprising: at least a portion having an inner liner and an outer cover plate which together form an interposed cooling chamber; a plurality of hollow elements extend from said liner and protrude into the cooling chamber, each hollow element defining a damping volume connected to a combustion chamber via a calibrated duct, such that during operation said hollow elements damp pressure pulsations and, also transfer heat.

An exemplary combustor is disclosed comprising: a combustion chamber; an interposed cooling chamber formed of an inner liner and an outer cover plate; and a plurality of hollow elements protruding into the cooling chamber, wherein each hollow element has an open-end connected to the combustion chamber via a duct.

BRIEF DESCRIPTION OF THE DRAWINGS

Further characteristics and advantages of the disclosure will be more apparent from the description of exemplary embodiments of the combustor according to the present disclosure, illustrated by way of non-limiting example in the accompanying drawings, in which.

DETAILED DESCRIPTION

Exemplary embodiments of the present disclosure provide a combustor by which the said problems of the known systems are eliminated.

Exemplary combustors disclosed herein can guarantee proper cooling in any operating condition, to increase its lifetime, and enable the control of NOx emissions.

Exemplary embodiments of the present disclosure provide a combustor in which the damping system is functionally integrated with the other components of the combustor and is also incorporated thereinto.

Figure 1:
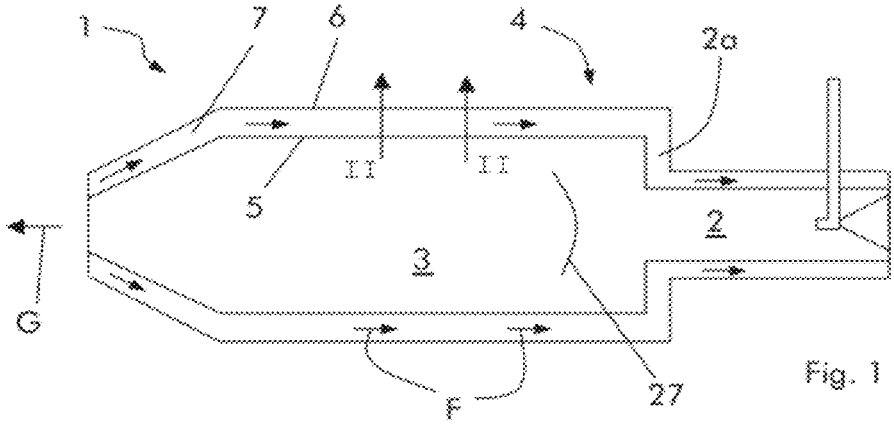
FIG. 1 is a schematic view of a combustor in accordance with an exemplary embodiment.
Figure 2:
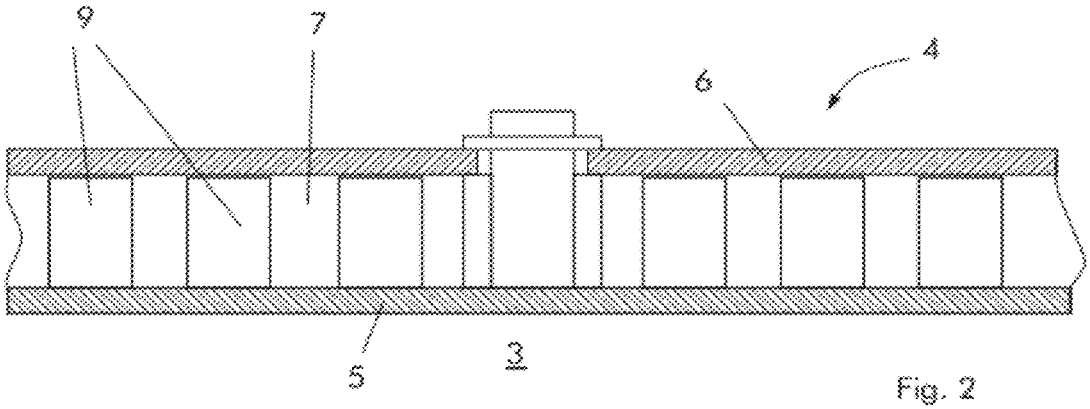
FIG. 2 is an enlarged schematic longitudinal cross section through line II-II of FIG. 1 in accordance with an exemplary embodiment.

FIG. 1 is a schematic view of a combustor in accordance with an exemplary embodiment. FIG. 2 is an enlarged schematic longitudinal cross section through line II-II of FIG. 1 in accordance with an exemplary embodiment. FIG. 1 shows a combustor 1 having a mixing tube 2 and a combustion chamber 3.

The combustor 1, including at least one of a mixing tube 2, a combustion chamber 3, and a front plate 2*a*, has at least a portion 4 that includes an inner liner 5 and an outer cover plate 6. The outer cover plate 6 together with the inner liner 5 establish (e.g. form, define) an interposed cooling chamber 7.

Any portions of at least one of the mixing tube 2, combustion chamber 3, and front plate 2*a* or also all the walls of at least one of the mixing tube 2, the combustion chamber 3, and front plate 2*a* may have this structure.

Figure 3:
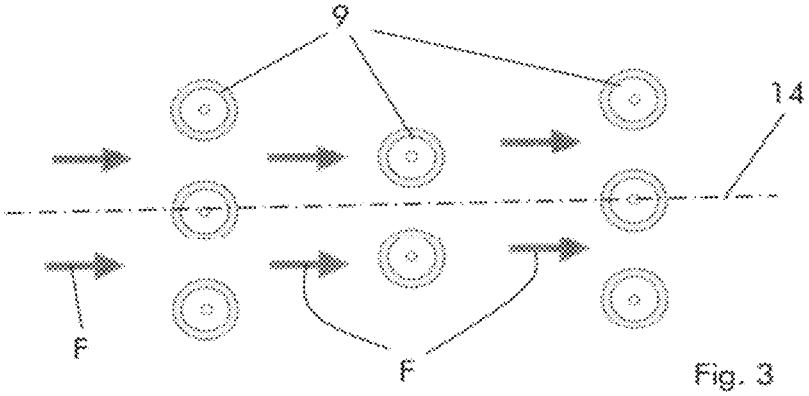
FIGS. 3-5 illustrate three different embodiments, respectively, of hollow element arrangements in accordance with an exemplary embodiment.
Figure 4:
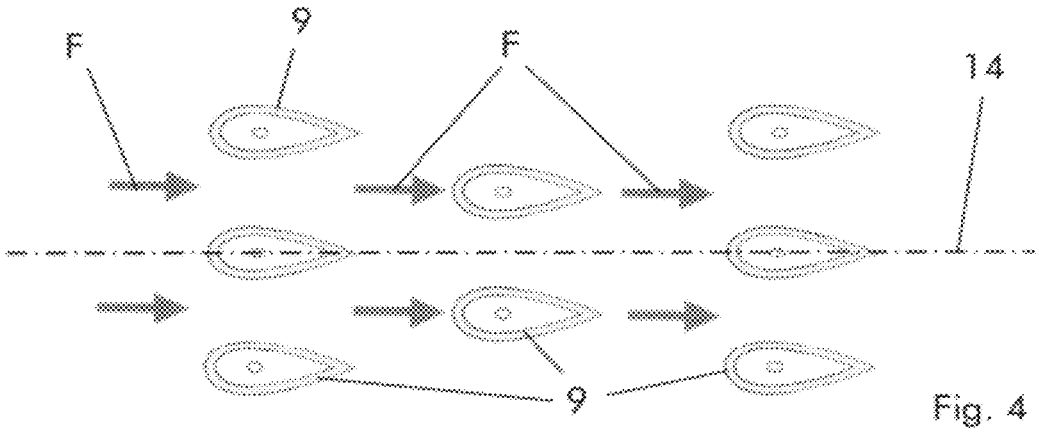
Figure 5:
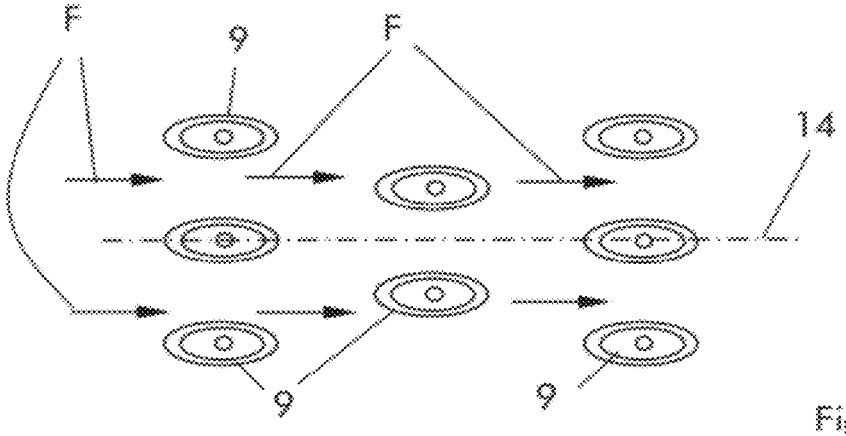

FIGS. 3-5 illustrate three different embodiments, respectively, of hollow element arrangements in accordance with an exemplary embodiment.

As shown in FIG. 3, portion 4 includes a plurality of hollow elements 9 that extend from the liner 5 and protrude into the cooling chamber 7. Each hollow element 9 defines a damping volume 10 connected with an open-end connected to the combustion chamber 3 (e.g., an inner portion or volume of the combustion chamber 3) via a calibrated duct 11 (in particular the length and the diameter of the duct are calibrated). During operation, the hollow elements 9 operate as Helmholtz dampers to damp pressure oscillations and, in addition, as they are connected to the liner 5 delimiting the hottest part of the gas turbine, they also collect heat from the liner 5 and dissipate it, transferring it to the cooling air. The hollow elements 9 can also have a purge hole 13 connecting the cooling chamber 7 with the damping volume 10. In particular, the purge hole 13 can be provided to increase cooling, but in other embodiments it may be absent to eliminate any air loss.

As the hollow elements 9 are arranged to transfer heat to dissipate it, other exemplary embodiments having various arrangements for their disposition are possible.

Figure 10:
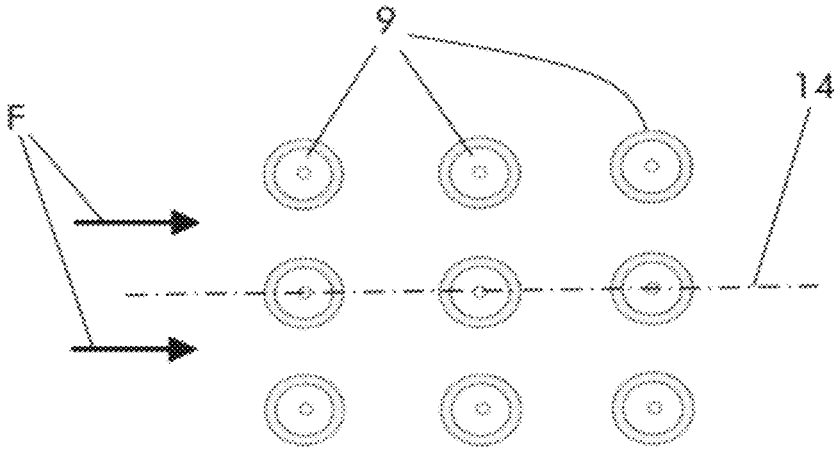
FIG. 10 illustrates a hollow element arrangement in accordance with an exemplary embodiment.

FIG. 10 illustrates a hollow element arrangement in accordance with an exemplary embodiment. FIG. 10 shows a first disposition with hollow elements 9 aligned along the cooling flow direction 14. FIGS. 3-5 show hollow elements 9 staggered with respect to the cooling flow direction 14. Exemplary dispositions such a those illustrated in FIGS. 3-5 can be used when larger heat transfer is desired.

The shape of the hollow elements 9 is chosen and optimised in accordance with the acceptable pressure drop. In this respect different shapes are possible for the hollow elements 9, such as cylindrical shape (FIG. 3) or elliptical shape (FIG. 5) or airfoil type shape (FIG. 4) or combinations thereof.

Figure 6:
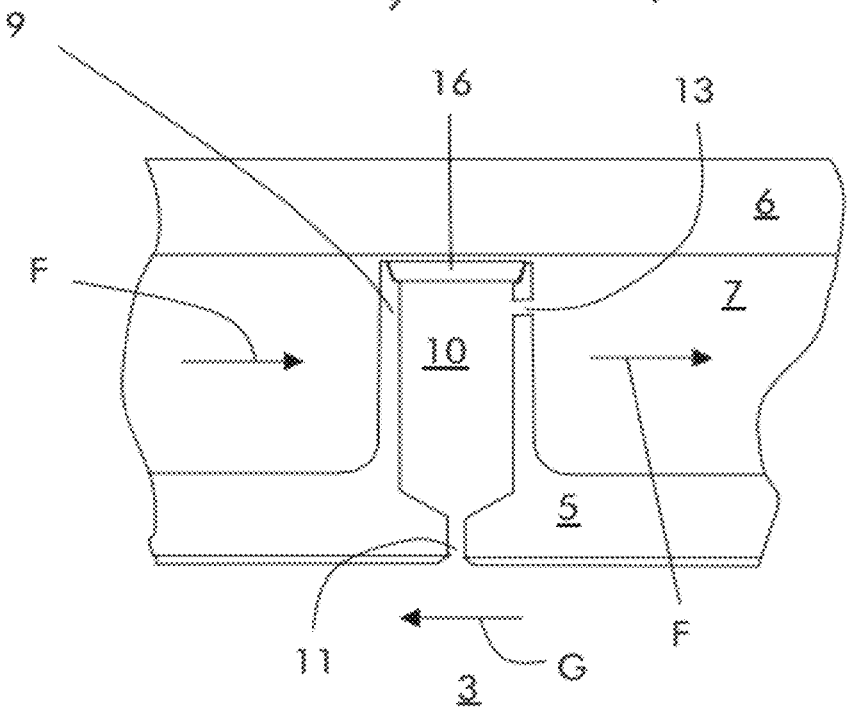
FIG. 6 is an enlarged cross section of a hollow element arrangement in accordance with an exemplary embodiment.

FIG. 6 is an enlarged cross section of a hollow element arrangement in accordance with an exemplary embodiment. As shown in FIG. 6, the top wall 16 of the hollow elements 9 is separated from the cover plate 6. In order to damp pressure oscillations in a wide range, different hollow elements 9 define different damping volumes 10 and/or the hollow elements 9 may have the damping volume 10 filled with a damping material 17 that increases dissipation and switches the pressure oscillation frequency that is damped by that particular damping volume to a value different from that provided by the empty damping volume 10.

Figure 7:
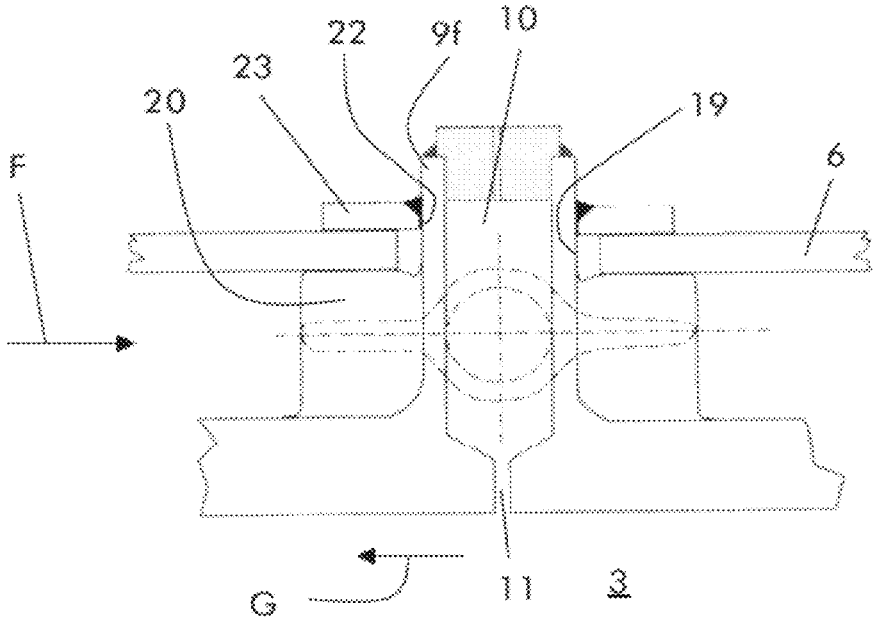
FIGS. 7-9 illustrate three different embodiments, respectively, of fixing hollow elements in accordance with an exemplary embodiment.
Figure 8:
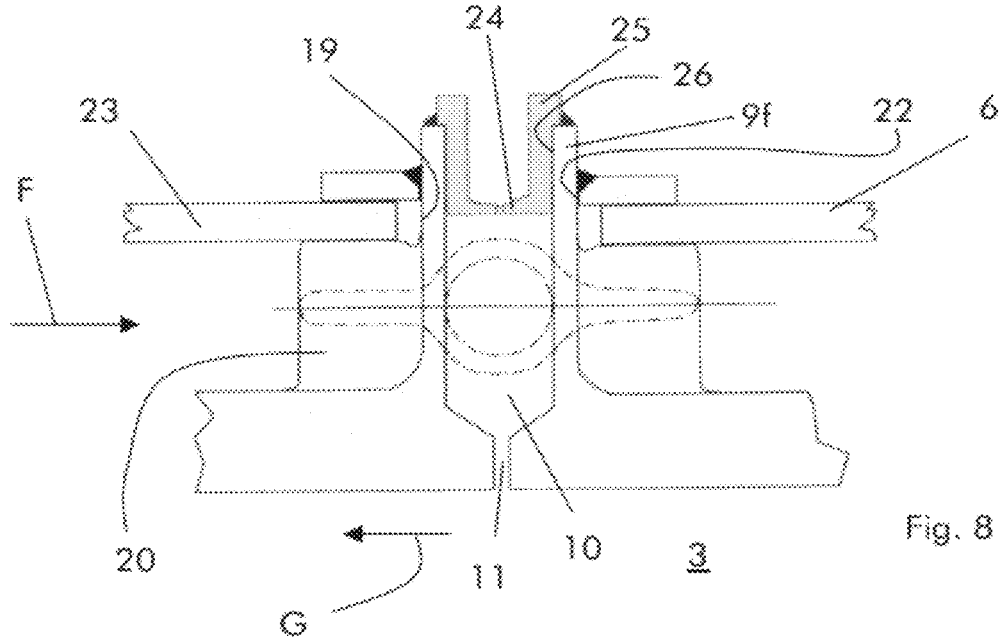
Figure 9:
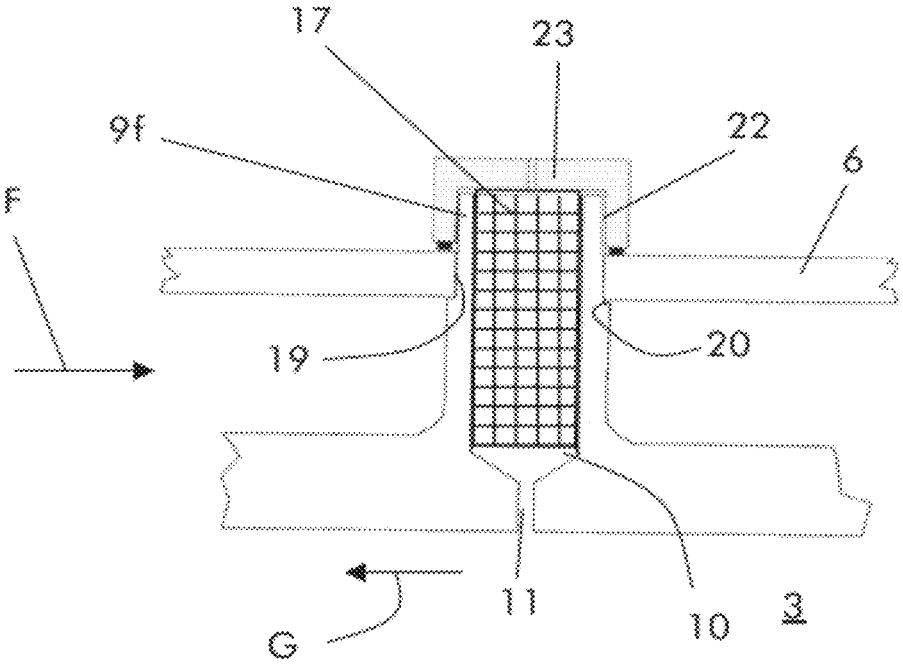

FIGS. 7-9 illustrate three different embodiments, respectively, of fixing hollow elements in accordance with an exemplary embodiment. As shown in FIGS. 7-9, in order to support the liner 5, fixing hollow elements **9*f* are connected to the cover plate 6. Fixing cover elements 9*f* have a structure similar to that of cover elements 9, but in addition they also have components that let them be connected to the cover plate 6. In this respect, the cover plate 6 is provided with through holes 19 in which the fixing hollow elements 9*f* (that are longer than hollow elements 9) are housed. Moreover, the fixing hollow elements 9*f* have shoulders 20 against which the cover plate 6 rests. Connection is achieved via threaded end portions 22 of the fixing hollow elements 9*f* connected to the cover plate 9 via bolts 23. In another exemplary embodiment different connections are possible such as brazed or welded connections. In addition to these features (that are common to the fixing hollow elements 9*f* of FIGS. 7, 8, 9), the fixing hollow elements 9*f* of FIG. 8 can have an adjustable top wall 24**.

The adjustable top wall 24 of the fixing hollow elements **9*f* of FIG. 8 includes a threaded cap 25 fixed into a corresponding threaded portion 26 of the fixing hollow elements 9*f*. Adjustment of the damping volume 10 lets the pressure oscillation frequency that is damped be regulated. The fixing hollow elements 9*f* of FIG. 9 is provided with the damping material 17. Provision of damping material 17 within the damping volume 10** also lets the pressure oscillation frequency that is damped be regulated.

The operation of an exemplary combustor of the present disclosure is apparent from the description and illustrations provided above, and from an exemplary operation that follows.

The mixture formed in the mixing tube 2 is combusted in the combustion chamber 3 generating hot gases G that are expanded in a turbine (not shown). In this respect reference 27 identifies the flame.

During combustion pressure oscillations can be generated and cause hot gases to go into and out from the damping volumes 10 of the hollow elements 9, **9*f* via the calibrated ducts 11. These oscillations cause energy to be dissipated and, thus, the pressure oscillations to be damped. In addition, since in the cooling chamber 7 cooling air circulates (as indicated by arrow F), the mixing tube 2, the combustion chamber 3 and the front plate 2*a*** are cooled.

Advantageously, since the hollow elements 9, **9*f* project into the cooling chamber 7, the cooling air impinges them such that a very intense cooling effect is achieved. When the hollow elements 9, 9*f* have a purge hole 13, cooling effect is further increased, because cooling air enters into the damping volume 10 via the purge hole 13 and cools the damping volume 10, and flows out from the damping volume 10 through the calibrated duct 11. This structure allows a very efficient damping effect to be achieved, because the combustor is provided with a plurality of Helmholtz dampers that if needed may also be placed along the whole wall of the combustor (i.e. mixing tube 2, combustion chamber 3 and front plate 2*a***).

In addition, because the damping volumes 10 can be of different sizes (volumes) and be chosen according to the desired specifications and the possibility to also introduce damping material 17 into the damping volumes 10, the structure of exemplary embodiments provided in the present disclosure can damp pressure oscillations in a very wide range. Moreover, the cooling effect is very efficient because the hollow elements 9, **9*f* that project into the cooling chamber 10 operate like heat exchanging fins. Cooling effect can also be increased in hollow elements 9 and/or 9*f* via purge holes 13**.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

1 combustor
2 mixing tube
**2*a*** front plate
3 combustion chamber
4 portion of 2 and/or 3 and/or **2*a***
5 liner
6 cover plate
7 cooling chamber
9 hollow element
**9*f*** fixing hollow element
10 damping volume
11 calibrated duct
13 purge hole
14 cooling flow direction
16 top wall of 9
17 damping material
19 through holes of 6
20 shoulders of **9*f***
22 threaded end portions of **9*f***
23 bolt

24 adjustable top wall of 9*f*
25 threaded cup
26 threaded portion of 9*f*
27 flame
F cooling air
G hot gases

What is claimed is:

1. A combustor comprising:

at least a portion having an inner liner and an outer cover plate which together form an interposed cooling chamber;

a set of hollow elements configured such that each hollow element in the set extends from said liner and protrudes into the cooling chamber, and each set of hollow elements defines a damping volume at least partly interposed within the cooling chamber and connected to a combustion chamber via a calibrated duct, such that during operation said hollow elements damp pressure pulsations and transfer heat, wherein in order to support the liner, at least some hollow elements define fixing hollow elements connected to the cover plate.

2. The combustor as claimed in claim 1, wherein the hollow elements have purge holes connecting the cooling chamber with the damping volume.

3. The combustor as claimed in claim 1, wherein the hollow elements are aligned along the cooling flow direction.

4. The combustor as claimed in claim 1, wherein the hollow elements are staggered with respect to the cooling flow direction.

5. The combustor as claimed in claim 1, wherein the hollow elements have one of a cylindrical, elliptical, airfoil type shape or combinations thereof.

6. The combustor as claimed in claim 1, wherein different sets of hollow elements define different damping volumes.

7. The combustor as claimed in claim 1, wherein the set of hollow elements have the damping volume filled with a damping material.

8. The combustor as claimed in claim 1, wherein a top wall of the set of hollow elements is separated from the cover plate.

9. The combustor as claimed in claim 1, wherein the cover plate is provided with through holes in which the fixing hollow elements are housed.

10. The combustor as claimed in claim 9, wherein the fixing hollow elements have shoulders against which the cover plate rests.

11. The combustor as claimed in claim 10, wherein the fixing hollow elements have a threaded end portion connected to the cover plate via bolts.

12. The combustor as claimed in claim 1, wherein the fixing hollow elements have an adjustable top wall.

13. The combustor as claimed in claim 12, wherein the adjustable top wall of the fixing hollow elements comprises a threaded cap fixed into a corresponding threaded portion of the fixing hollow elements.

* * * * *